US008880215B2

(12) United States Patent
De Leo et al.

(10) Patent No.: US 8,880,215 B2
(45) Date of Patent: Nov. 4, 2014

(54) AUTOMATED LETTER MOVEMENT SYSTEM ALMS

(75) Inventors: Guido Teodoro De Leo, Genoa (IT); Cristiano Frazone, Genoa (IT); Enrico Rosa, Rapallo (IT)

(73) Assignee: Seleg Elsag S.p.A. (IT)

( * ) Notice: Subject to any disclaimer, the term of this patent is extended or adjusted under 35 U.S.C. 154(b) by 332 days.

(21) Appl. No.: 13/267,586

(22) Filed: Oct. 6, 2011

(65) Prior Publication Data

US 2012/0179291 A1 Jul. 12, 2012

(30) Foreign Application Priority Data

Oct. 6, 2010 (IT) ..... TO2010A0823

(51) Int. Cl.
*B07C 3/10* (2006.01)
*B07C 1/04* (2006.01)
*B07C 3/08* (2006.01)

(52) U.S. Cl.
CPC .... *B07C 3/08* (2013.01); *B07C 1/04* (2013.01)
USPC ..... 700/224; 700/223; 705/408; 209/584; 209/703; 209/509

(58) Field of Classification Search
USPC ..... 700/224
See application file for complete search history.

(56) References Cited

U.S. PATENT DOCUMENTS 5,908,116 A * 6/1999 Levaro et al. ..... 209/584
6,366,828 B1 * 4/2002 De Leo et al. ..... 700/228
2002/0069187 A1 * 6/2002 Barnum et al. ..... 705/408
2010/0049360 A1 * 2/2010 Stemmle ..... 700/223
2010/0241272 A1 * 9/2010 Grimse et al. ..... 700/224
2011/0046775 A1 * 2/2011 Bailey et al. ..... 700/224

FOREIGN PATENT DOCUMENTS

EP 0923997 A2 6/1999
EP 1500440 A1 1/2005

OTHER PUBLICATIONS

Italian Patent & Trademark Office; Search Report for Italian Patent Application No. TO20100823; Apr. 7, 2011.

* cited by examiner

*Primary Examiner* — Gene Crawford
*Assistant Examiner* — Kyle Logan

(57) ABSTRACT

An automated letter movement system comprising: postal item processing lines adapted to receive incoming postal items; SSM devices configured to receive at input postal items from at least one postal item processing line and adapted to group the postal items forming shingled groups of partially overlapping postal items; a transportation system adapted to move the shingled groups generated by the SSM devices along a feed direction; postal item output processing lines adapted to carry out the sorting of the postal items fed into it; singulator models receiving the shingled groups arriving from said transportation system, each singulator module being configured to only singularize the postal items belonging to a specific group and to send the singularized postal items to a postal item output processing line configured to implement a sorting program for the postal items subjected to singularization.

24 Claims, 5 Drawing Sheets

AUTOMATED LETTER MOVEMENT SYSTEM ALMS

BACKGROUND OF THE INVENTION

In mail sorting processes it is known to use a plurality of AFCS (Advanced Facer Canceller System) devices, each of which receives flat rectangular postal items (letters, postcards, documents and magazines in envelopes, etc.) coming from a mail collection and is configured to scan the items fed into it in order to separate items that can be subjected to a mail mechanization cycle from those unsuited to such a cycle. In general, AFCS devices are able to associate a code (for example, a bar code) with a postal item (which is also stamped) that is subsequently used in a mail sorting process.

The mechanizable postal items collected from the AFCS devices are transported (normally using manually-operated trolleys) to the inputs of the DBCS (Delivery Bar Code Sorter) devices that are able to carry out the sorting of the postal items fed in using the codes stamped on the postal items.

The manual handling of postal items constitutes a serious inefficiency in the mail sorting process as it entails significant amounts of time and commits human resources.

SUMMARY OF THE INVENTION

The object of the present invention is that of making an automatic letter movement system such as to interface the AFCS devices with the DBCS devices in an optimal manner, eliminating the drawbacks of the known art.

The above stated object is achieved by the present invention in so far as it concerns an ALMS (Automated Letter Movement System) characterized in that it comprises: a plurality of postal item processing lines, for example AFCS (Advanced Facer Canceller System) devices, each of which receives postal items as input; a plurality of SSM devices, each of which receives postal items coming from at least one postal item processing line as input and is able to group the postal items into shingled sets of partially overlapping postal items, aligned along a feed direction and having reciprocally spaced corresponding edges, each SSM being configured to carry out at least one sorting cycle in order to generate different shingled sets, each of which comprises postal items characterized by a common sorting criterion, for example belonging to the same postal area or the same kind of customer; at least one transportation system able to transfer the shingled sets generated by the SSMs along a first feed direction; a plurality of postal item output processing lines, in particular DBCS (Delivery Bar Code Sorter) devices, each of which is able to carry out the sorting of the postal items fed into it; and a plurality of singulators receiving the shingled sets arriving from said transportation system, each singulator being configured to only singularize the postal items belonging to a specific set and being able to send the singularized postal items to a respective postal item output processing line configured to implement a specific sorting program for the postal items belonging to the set that was subjected to singularization.

In this way, high integration is achieved between the AFCS devices and the DBCS devices, which reduces running costs and minimizes the space occupied.

BRIEF DESCRIPTION OF THE DRAWINGS

The invention will now be described with reference to the attached figures, which represent a preferred non-limitative embodiment, where.

DETAILED DESCRIPTION OF THE INVENTION

Figure 1:
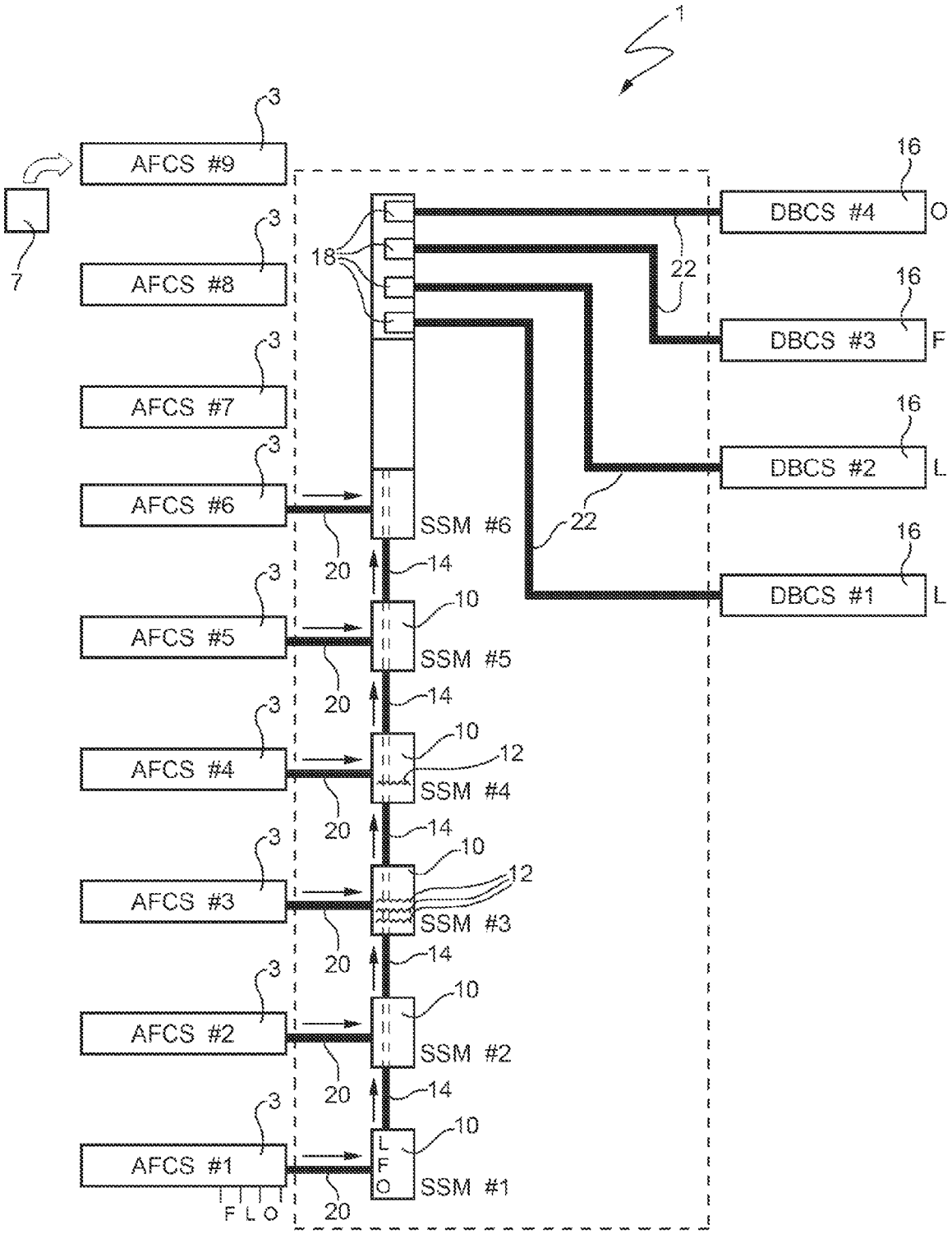
FIG. 1 shows an ALMS (Automated Letter Movement System) made according to a first embodiment.

In FIG. 1, reference numeral 1 indicates, as a whole, an ALMS (Automated Letter Movement System) made according to a first embodiment.

The system 1 comprises:

- a plurality (nine in the specific example) of AFCS (Advanced Facer Canceller System) devices 3, each of which receives as input flat rectangular postal items 7 (letters, postcards, documents and magazines in envelopes, etc.) coming from a mail collection and is configured to scan the items 7 fed into it in order to separate items that can be subjected to a mail mechanization cycle from those unsuited to such a cycle;
- a plurality (six in the specific example) of SSMs 10, each of which receives as input mechanizable postal items coming from at least one AFCS device 3 and is able to group the postal items into shingled sets 12 of partially overlapping postal items, aligned along a feed direction and having reciprocally spaced corresponding edges; each SSM 10 is configured to carry out at least one sorting cycle in order to generate different sets (F, L and O), each of which comprises postal items characterized by a common sorting criterion;
- a conveyor-belt transportation system 14 able to transfer the shingled sets 12 generated by the SSMs 10 along a first common feed direction indicated by an arrow;
- a plurality (four in the specific example) of DBCS (Delivery Bar Code Sorter) devices 16, each of which is able to carry out the sorting of the postal items fed into it;
- a plurality (four in the specific example) of singulators 18 of known type receiving the shingled sets 12 arriving from the conveyor-belt transportation system 14; each singulator 18 is configured to only singularize the postal items belonging to a specific set and is able to send the singularized postal items to a respective DBCS device 16 configured to implement a specific sorting program for the postal items belonging to the set that was subjected to singularization.

In particular, the singulators 18 are arranged along the conveyor-belt transportation system 14 at an end portion of the transportation system.

Each singulator 18 communicates with an input of a respective DBCS device 16 by means of a transportation segment 22; it follows that the number of singulators 18 (four in the example) is equal to the number of DBCS devices 16.

The AFCS devices 3 are of known type, for example made according to patent US2008133049 and therefore shall not be discussed further.

Each AFCS device 3 has an output communicating with a respective SSM 10 by means of a transportation segment 20. In this way, the postal items leaving the AFCS device (and hence mechanizable) are fed into the SSM 10 (this also of known type, for example made according to patent EP-654.309), which implements a sorting program on the basis of which each shingled set 12 comprises postal items characterized by a common sorting criterion, for example belonging to the same postal area (e.g. set L items belonging to an urban area, set F items belonging to a suburban area and set O items belonging to large customers such as banks, insurance companies, etc.).

Lastly, the DBCS (Delivery Bar Code Sorter) devices 16 are also of known type, for example made according to patent U52008133049.

Each SSM 10 is configured to operate independently of the other SSMs 10. Similarly, each singulator 18 is configured to operate independently of the other singulators.

Figure 2:
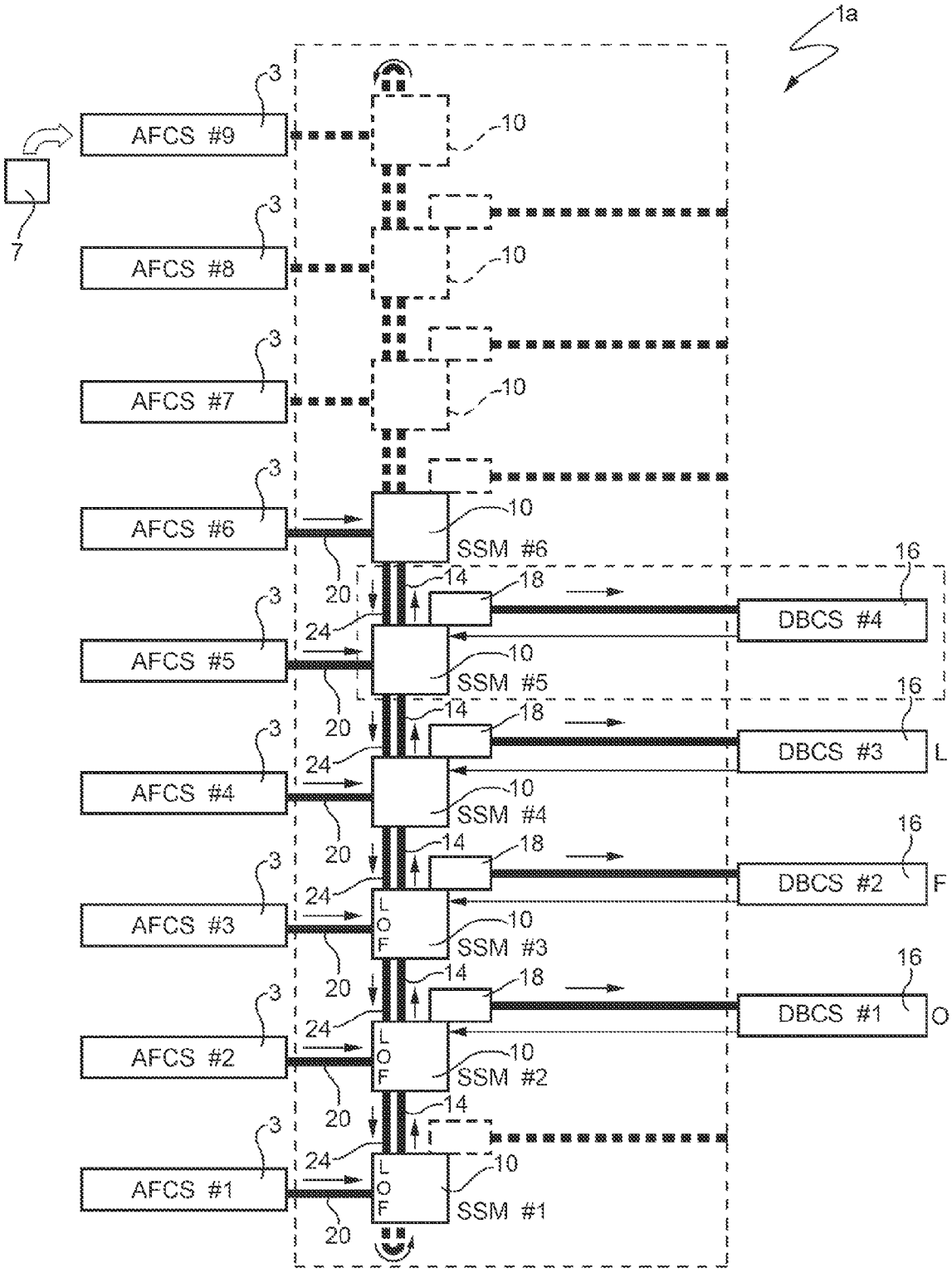
FIG. 2 shows an ALMS (Automated Letter Movement System) made according to a second embodiment.

In FIG. 2, reference numeral la indicates, as a whole, an ALMS (Automated Letter Movement System) made according to a second embodiment. In the following description, identical parts will be indicated with the same reference numeral.

The system 1a comprises:

- a plurality (nine in the specific example) of AFCS (Advanced Facer Canceller System) devices 3, each of which receives as input flat rectangular postal items 7 (letters, postcards, documents and magazines in envelopes, etc.) coming from a mail collection and is configured to scan the items 7 fed into it in order to separate items that can be subjected to a mail mechanization cycle from those unsuited to such a cycle;
- a plurality (from six to nine in the specific example) of SSMs 10, each of which receives as input mechanizable postal items coming from at least one AFCS device 3 and is able to group the postal items into shingled sets 12 of partially overlapping postal items, aligned along a feed direction and having reciprocally spaced corresponding edges; each SSM 10 is configured to carry out at least one sorting cycle in order to generate different sets (F, L and O), each of which comprises postal items characterized by a common sorting criterion;
- a first conveyor-belt transportation system 14 able to transfer the shingled sets 12 generated by the SSMs 10 along a first common feed direction indicated by an arrow;
- a second conveyor-belt transportation system 22 able to transfer the shingled sets 12 generated by the SSMs 10 along a second common feed direction indicated by an arrow and opposite to the first—as shall be explained further on, each SSM 10 communicates with the first transportation system 14 and with the second transportation system 24 to receive shingled sets 12 that move along the first and the second transportation system 24;
- a plurality (four in the specific example) of DBCS (Delivery Bar Code Sorter) devices 16, each of which is able to carry out the sorting of the postal items fed into it;
- a plurality (four in the specific example) of singulators 18 of known type, each of which receives as input shingled sets 12 coming (in ways that shall be indicated further on) from a respective SSM 10 to which the singulator is paired; each singulator 18 is configured to only singularize the postal items belonging to a specific set and is able to send the singularized postal items to a respective DBCS device 16 configured to implement a specific sorting program for the postal items belonging to the set that was subjected to singularization.

In this way, each singulator 18 associated with a respective SSM 10 is able to singularize the postal items belonging to a specific set that transits along transportation system 14 or the supplementary system 24 or that comes from the SSM 10 itself.

Furthermore, the first transportation system 14 and the second transportation system 24, both of the conveyor belt type, have end portions communicating with one another in order to create a closed loop path.

Figure 5:
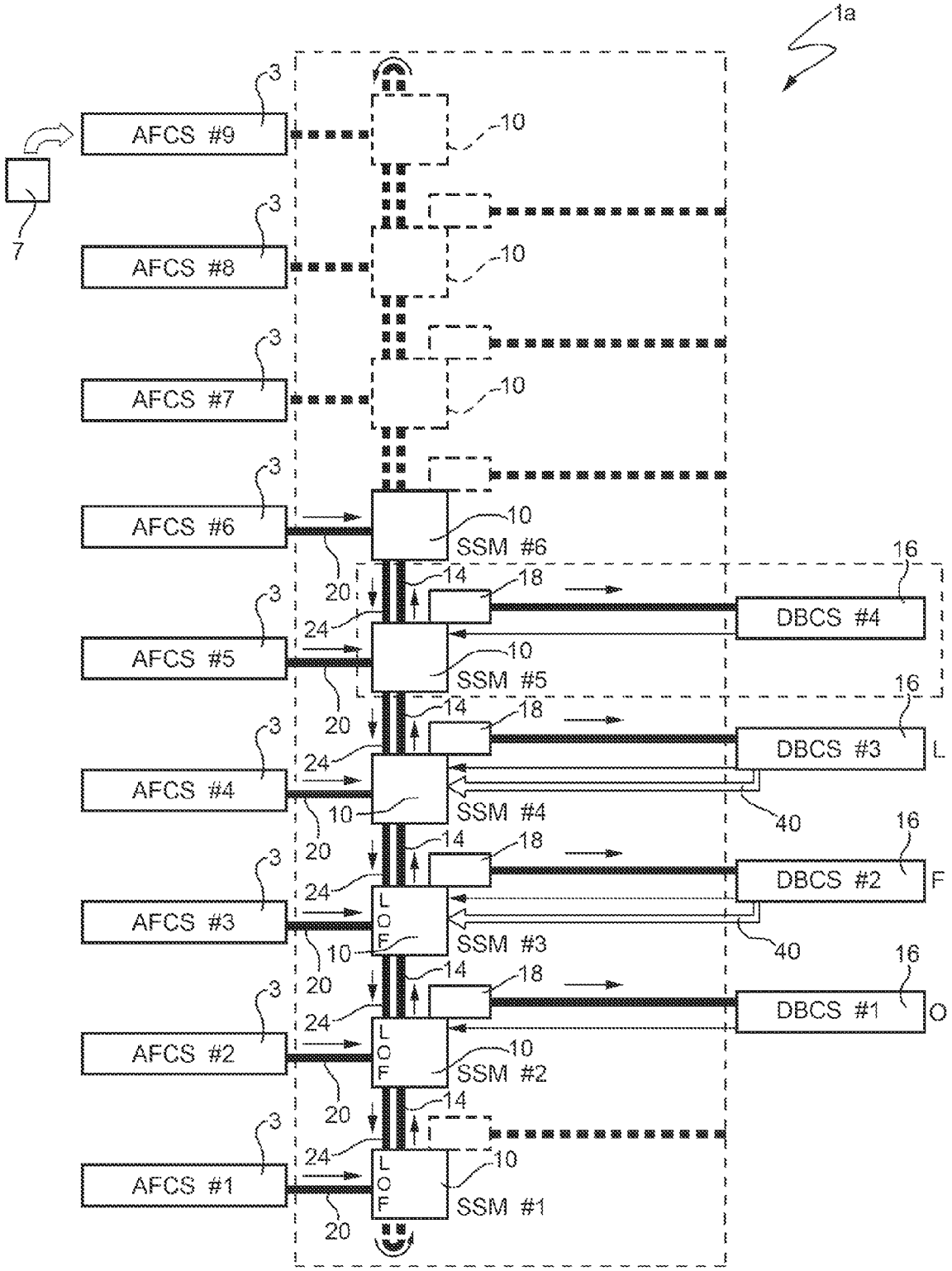
FIG. 5 shows a variant of the system in FIG. 1.

FIG. 5 shows a variant of the system in FIG. 2. As shown, each DBCS device 16 has outputs communicating with an input of the respective SSM 10 by means of a return path 40 to route the postal items sorted by the previously used sorting program to the SSMs 10.

In particular, according to the variant in FIG. 5, the system is configured so as to perform the following operations:

a) collect the items present at the various outputs of the DBCS device 16 according to their indexing order (the items are preferably grouped in bundles gathered in respective containers—for example, the postal items could have undergone a first sequencing step);

b) achieve the feeding—through the initial part of the device 16 and by means of said return path 40—of the items collected from the outputs to the SSM 10;

c) the SSM 10 is configured to form shingled sets of postal items on the basis of a sorting program (for example, each set comprises items belonging to a postal sub-area)—the first and the second transportation systems 14 and 24 are disconnected during the operations of step c) and therefore the shingled sets cannot be exchanged between the various SSMs 10;

d) the shingled sets formed within the SSM 10 are subsequently fed to the respective singulator 18, which feeds them to the DBCS device 16 to carry out a second postal processing step, for example a second sequencing step.

According to the variant in FIG. 5, the system can perform the following operations:

a') achieve the feeding of the items to be subjected to a sorting process or a first sequencing step—through the initial part of the DBCS device 16; if necessary, the device can be configured with opportune address recognition and code printing subsystems (as happens, for example, on DBCS systems with known Input-Output Subsystems);

b') forward the items—by means of said return path 40—to the SSM 10;

c') the SSM 10 is configured to form shingled sets of postal items on the basis of a sorting program (for example, each set comprises items belonging to a postal sub-area)—the first and the second transportation systems 14 and 24 are connected during the operations of step c); the shingled sets are consolidated according to pre-sorting logic based on the sorting programs processed by the DBCSes 16 and said shingled sets can be opportunely exchanged between the various SSMs 10;

d') the shingled sets formed inside the SSM 10 or received from other SSMs 10 by means of the first and/or second transportation systems 14 and 24 are subsequently fed to the respective singulator 18, which feeds them to the DBCS device connected to it for carrying out mail processing, for example sorting by regional or city areas or for a first sequencing step.

Figure 3:
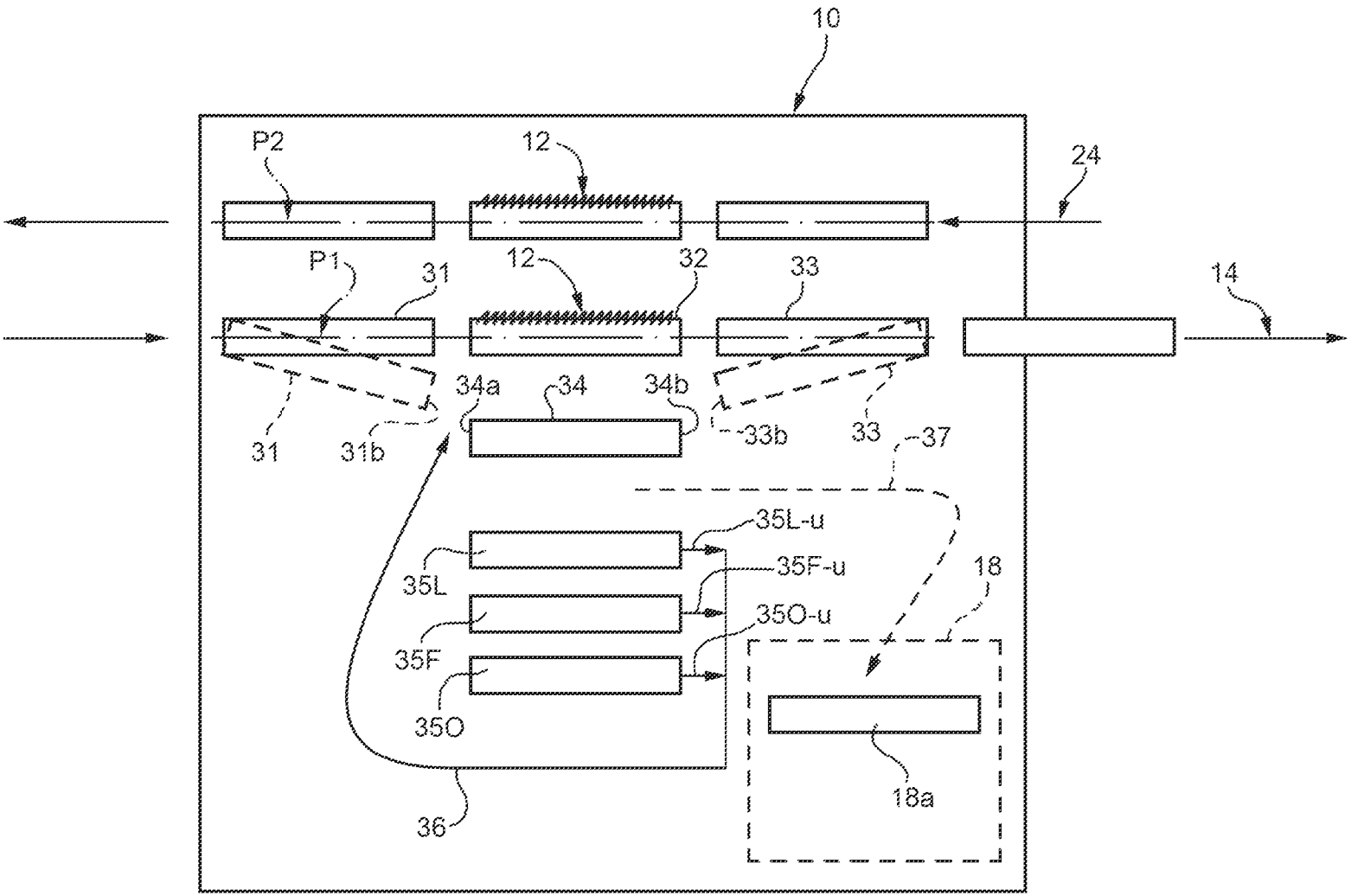
FIG. 3 shows a detail of the system in FIG. 2.

FIG. 3 shows a schematic side view of an SSM 10 and the first and the second conveyor-belt transportation systems 14 and 24.

In particular, the first and second conveyor-belt transportation systems 14 and 24 extend facing one another and lie on mutually parallel horizontal planes P1 and P2. In this way, the sets of postal items 12 move substantially coplanar to the planes P1 and P2 in opposite directions. Alternatively, the transportation systems 14 and 24 could extend facing one another and lie on substantially coincident horizontal planes.

The first conveyor-belt transportation system 14 forms a first straight conveyor-belt transportation segment 31, a second intermediate straight conveyor-belt transportation segment 32 and a third straight conveyor-belt transportation segment 33 at the SSM (10).

In particular, the first and the third conveyor-belt transportation segments 31 and 33 are mobile under the thrust of respective actuators (of known type and not shown for simplicity) between a resting position in which the straight conveyor-belt segments 31 and 33 are substantially horizontal (indicated in FIG. 3 with solid lines) and an activation position (indicated in FIG. 3 with dashed lines) in which the straight conveyor-belt segments 31 and 33 are inclined with respect to the horizontal to provide at least two of the following operative arrangements:

- a first bypass operating position in which the first and the third segments 31 and 33 are arranged in the resting position so that the first, second and third transportation segments 30, 31 and 32 are aligned and contiguous in order to enable the transfer of the sets of postal items 12 through the SSM 10 (in other words, segments 30, 31 and 32 create a portion of the transportation system 14 that passes through the SSM 10);
- a second set-loading operating position into the SSM 10 in which at least the first transportation segment 31 is arranged in the activation position, where an end portion 31*b* of the first transportation segment 30 communicates with the input 34*a* of a fourth internal straight conveyor-belt transportation segment 34 of the SSM 10, to divert sets 12 fed to the SSM 10 onto the fourth transportation segment 34; and
- a third set-unloading operating position from the SSM 10 in which at least the third transportation segment 33 is arranged in the activation position, where an end portion 33*b* of the third transportation segment communicates with the output 34*b* of the fourth internal segment 34, to feed sets 12 held on the fourth transportation segment 34 to the first transportation system 14.

The SSM 10 comprises a plurality of accumulation segments 35L, 35F and 35O (three in the example, but any number could be used) in which different shingled sets 12 characterized by common assorting criteria are held after the sorting operations carried out by the device 10; a first internal transportation system 36 (of known type and therefore indicated schematically) is provided configured to connect the output 35L-u, 35F-u or 35O-u of the accumulation segments 35L, 35F and 35O with the input 34*a* of the fourth segment 34 and enable shingled sets 12 formed inside the SSM 10 to be fed to the fourth segment 34. The implementation of the third set-unloading operating position enables the subsequent unloading of a shingled set 12 arranged on the fourth segment 34 (and coming from the accumulation segments 35L, 35F or 35O) to the first transportation system 14.

A second internal transportation system 37 (of known type and therefore indicated schematically) is also provided that is able to connect the output 34*b* of the fourth segment 34 with an input 18*a* (schematically indicated) of the singulator 18 coupled to said SSM 10 to enable the transfer of a shingled set of postal items fed to the fourth segment 34 to the singulator 18.

Lastly, a third internal transportation system 38 (this also of known type and therefore only shown schematically) is provided configured to directly connect one or more outputs 35L-u, 35F-u or 35O-u of the accumulation segments 35L, 35F and 35O with the input 18*a* of the singulator 18.

In a preferred embodiment (not shown for simplicity) the fourth segment 34 could move with a rectilinear translational motion (under the thrust of actuators of known type and not shown) between:

- an upper position in which it is able to couple with the ends of the first/third segments 31 and 33 arranged in the activation position to receive/feed shingled sets 12 of postal items; and
- a lower position in which its input is interfaced with the first internal transportation system 36 and its output interfaced with the second internal transportation system 37.

Figure 4:
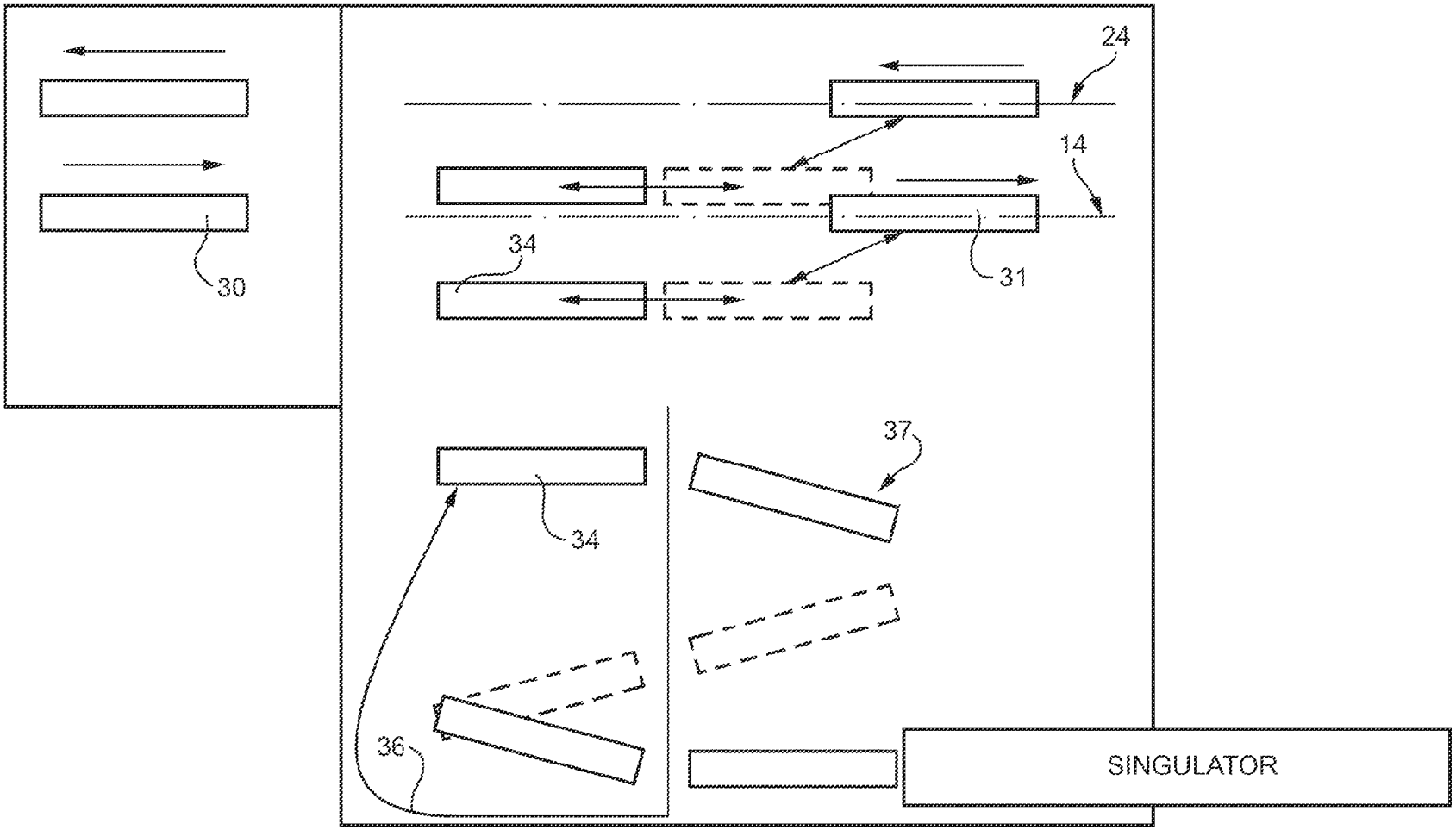
FIG. 4 shows a variant of the detail in FIG. 3.

In alternative to that described above and in accordance with the embodiment shown in FIG. 4, the fourth segment 34 could move with a rectilinear translational motion (under the thrust of actuators of known type and not shown) between:

- an upper position in which it is able to couple with the ends of the first/third segments 31 and 33 arranged in the resting position to receive/feed shingled sets 12 of postal items; and
- a lower position in which its input is interfaced with the first internal transportation system 36 and its output interfaced with the second internal transportation system 37.

The first segment 31 could, instead, move with a rectilinear translational motion (under the thrust of actuators of known type and not shown) between:

- a front position in which it is able to couple with the ends of the fourth segment 34 arranged in the interchange position to receive/feed shingled sets 12 of postal items; and
- a rear resting position in which it is part of a transportation system 14 or 24.

In use, postal items 7 are fed to the AFCS devices 3 that, for example, separate the mechanizable postal items from those that cannot be mechanized (which are locally discarded by the AFCS device 3 itself) and/or obliterate them and/or acquire images of the items in order to obtain address identification and thus associate or apply a code to the postal items 7, typically but not necessarily a bar code. The thus processed mechanizable items are fed to the various SSMs 10 via the transportation segments 20. Each SSM 10—depending on its sorting program—forms different shingled sets of postal items (accumulated in the accumulation segments 351L, 35F and 35O), each of which comprises postal items characterized by a common sorting criterion.

For example, postal items 7 belonging to an urban area can be accumulated in shingled form in accumulation segment 35L and postal items 7 belonging to a suburban area can be accumulated in shingled form in segment 35F, while postal items 7 belonging to large customers, e.g. banks or insurance companies, can be accumulated in shingled form in accumulation segment 35O.

The sets of postal items, the type of which corresponds to that sorted by the DBCS unit 16 associated with the SSM 10 through the singulator 18, are fed to the input 18*a* of the singulator so as to directly reach the DBCS unit 16.

For example, assuming that DBCS device #1 only sorts sets of postal items O (large customers), then the postal items present in accumulation segment 35O of SSM #2 are fed from the third transportation system 38 to the singulator 18 and from here reach DBCS device #1, which only sorts sets of postal items O.

The sets of postal items of a type not corresponding to that sorted by the DBCS unit 16 associated with the SSM 10 through the singulator 18 are fed to the transportation system 14.

For example, assuming that DBCS device #1 only sorts sets of postal items O (large customers), then the postal items present in accumulation segments 35L and 35F of SSM #2 are fed from the first transportation system 36 to the fourth segment and from here reach the first transportation system 14, according to whether the third segment 35 is arranged in the activation position.

The sets of postal items 12 move along the transportation system 14 (and successive transportation system 24) until they reach an SSM 10 associated with a DBCS device that sorts that set of postal items.

For example, assuming that DBCS device #2 associated with SSM #3 sorts postal items F, the arrangement of the first transportation segment 31 in the activation position is effected in SSM #3 to enable the transfer of the shingled set of postal items F to the fourth segment 34, the second internal transportation device 37 and the singulator 18 in succession, and then to DBCS device #2, which sorts postal items F. Instead, postal items L pass through device 10, along segments 30 and 31 arranged in the resting position.

Continuing with the example and assuming that DBCS device #3 associated with SSM #4 sorts postal items L, the arrangement of the first transportation segment 31 in the activation position is effected in SSM #4 to enable the transfer of the shingled set of postal items L to the fourth segment 34, the second internal transportation device 37 and the singulator 18 in succession, and then to DBCS device #3, which sorts postal items L.

The invention claimed is:

1. An automated letter movement system (ALMS) characterized in that it comprises:

a plurality of postal item processing lines (3), for example AFCS (Advanced Facer Canceller System) devices, each of which receives incoming postal items (7);

a plurality of SSM devices (10), each of which receives at input postal items from (20) at least one postal item processing line (3) and is adapted to group the postal items forming shingled groups (12) of partially overlapping postal items, aligned along a feed direction and having corresponding edges spaced from one another, each SSM device (10) being configured to carry out at least one sorting cycle in order to generate different shingled groups (F, L, O), each of which comprises postal items characterized by a common sorting criterion, for example belonging to the same postal area or the same kind of customer;

at least a transportation system (14) adapted to move the shingled groups (12) generated by the SSM devices (10) along a first feed direction;

a plurality of postal item output processing lines (16), in particular DBCS (Delivery Bar Code Sorter) devices, each of which is adapted to carry out the sorting of the postal items fed into it; and a plurality of singulator modules (18) receiving the shingled groups arriving from said transportation system (14), each singulator module (18) being configured to only singularize the postal items belonging to a specific group and being adapted to send the singularized postal items to a respective postal item output processing line (16) configured to implement a specific sorting program for the postal items belonging to the group that was subjected to singularization.

2. The system according to claim 1 wherein the input to the SSM modules (10) is made of a return path (40) for the transportation of the postal items sorted by a postal item output processing line.

3. The system according to claim 1 wherein a return path (40) is provided for the transportation of the postal items sorted by a postal item output processing line to a respective SSM device (10), said system being configured to perform the following operations:

a) collect the items present at the various exits of the postal item output processing line;

b) achieve the feeding of the collected items by means of said return path (40);

c) the SSM device (10) being configured to form groups of shingled postal items by sorting the items coming from the return path (40) and forming groups of partially overlapping postal items--during the operations of step c) the first and the second transportation systems (14, 24) are disconnected and therefore the shingled groups cannot be exchanged between the various SSM devices (10); and d) the shingled groups formed within the SSM device are subsequently fed to the respective singulator (18), which feeds them to the postal item output processing line to carry out a second postal processing step, for example a second sequencing step.

4. The system according to claim 1, wherein each singulator device (18) communicates (22) with an input of a respective DBCS device (16).

5. The system according to claim 1, wherein each SSM device (10) is configured to operate independently of the other SSM devices (10).

6. The system according to claim 1, wherein each singulator device (18) is configured to operate independently of the others.

7. The system according to claim 1, wherein each processing line receives postal items coming from a mail collection and is configured to scan the items fed into it in order to separate items that can be subjected to a mail mechanization cycle from those unsuited to such a cycle, the mechanizable items being fed to the SSM devices (10).

8. The system according to claim 1, wherein said singulator modules (18) are arranged along said transportation system.

9. The system according to claim 8, wherein said singulator modules (18) are arranged at an end portion of said transportation system (14).

10. The system according to claim 8 wherein said transportation system (14) is of the conveyor belt type.

11. The system according to claim 1, wherein a supplementary transportation system (24) is provided, communicating with the transportation system and adapted to transfer the shingled groups generated by the SSM devices (10) along a second feed direction opposite to the first; each SSM device (10) communicates with the transportation system (14) and with the supplementary transportation system (24) to receive shingled groups (12) which move along the respective transportation systems (14, 24).

12. The system according to claim 11, wherein said transportation system and said supplementary transportation system have end portions connected to one another in order to transfer shingled groups (12) between the two transportation systems (12, 24).

13. The system according to claim 11 wherein each singulator module (18) is associated with a respective SSM device (10) and is adapted to singularize the postal items belonging to a specific group that transits along the transportation system or the supplementary transportation system (24) or that comes from the SSM device (10).

14. The system according to claim 11 wherein the first and second transportation systems (14, 24) extend facing one another and lie on mutually parallel horizontal planes.

15. The system according to claim 11 wherein the first and second transportation systems (14, 24) extend side by side and lie on substantially coincident horizontal planes.

16. The system according to claim 1, wherein said SSM device (10) comprises a plurality of accumulation segments (35L, 35F and 35O in which different shingled groups (12) are held following the sorting operations carried out.

17. The system according to claim 16, wherein an internal transportation system (38) is provided configured to directly connect one or more outputs (35L-u, 35F-u and 35O-u) of the accumulation segments (35L, 35F and 35O) with the input (18*a*) of the singulator module (18).

18. The system according to claim 1, wherein said first transportation system (14) forms at said SSM device (10) a first transportation segment (31), a second intermediate transportation segment (32) and a third transportation segment (33); said first (31) and said third (33) transportation segment being mobile under the thrust of actuator means between a resting position and an activation position to obtain at least two of the following operative arrangements:

a first bypass operating position in which the first (31) and the third (33) segments are arranged in the resting position so that the first (31), the second (32) and the third (33) transportation segments are aligned and contiguous in order to enable the transfer of group of postal items (12) through the SSM device (10);

a second group-loading operating position into the SSM device (10) in which at least the first transportation segment (31) is arranged in the activation position, where an end portion (31*b*) of the first transportation segment (31) communicates with the input (34*a*) of a fourth internal transportation segment (34) of the SSM device (10), to divert groups (12) fed to the SSM device (10) onto the fourth transportation segment (34); and a third group-unloading operating position from the SSM device (10) in which at least the third transportation segment (33) is arranged in the activation position, where an end portion (33*b*) of the third transportation segment (33) communicates with the output (34*b*) of the fourth internal transportation segment (34) of the SSM device (10), to feed groups (12) held in the fourth transportation segment (34) to the first transportation system (14).

19. The system according to claim 18, wherein it is provided a second internal transportation system (36) configured to connect the outputs (35L-u, 35F-u and 35O-u) of the accumulation segments (35L, 35F and 35O) with the input (34*a*) of the fourth segment (34) and enable the feeding of shingled groups (12) formed within the SSM device (10) to the fourth segment (34), the implementation of the third operating position enabling the subsequent unloading of a shingled group (12) arranged on the fourth segment (34) onto the first transportation system (14).

20. The system according to claim 18, wherein a third internal transportation system (37) is provided that is adapted to connect the output of the fourth segment with an input of the singulator module coupled to said SSM device (10) to enable the transfer of a shingled group of postal items fed to the fourth segment (39) to said singulator module (18).

21. The system according to claim 18, wherein said fourth segment (34) is mobile with a linear translational motion under the thrust of actuators between:

an upper position in which said fourth segment (34) is adapted to couple with the first/third segment (31, 33) to receive from/feed to shingled groups (12) of postal items; and a lower position in which said fourth segment (34) has its input interfaced with the first internal transportation system (36) and its output interfaced with the second internal transportation system (37).

22. The system according to claim 18, wherein said fourth segment (34) is mobile with a linear translational motion under the thrust of actuators between:

an upper position in which said fourth segment (34) is adapted to couple with at least said first segment (31) from which to receive and/or to which to feed shingled groups (12) of postal items; and a lower position in which said fourth segment (34) has its input interfaced with the first internal transportation system (36) and its output interfaced with the second internal transportation system (37).

23. The system according to claim 22, wherein said first segment (31) is mobile with a linear translational motion under the thrust of actuators between:

a front position in which said first segment (31) is adapted to couple with said fourth segment (34) from which to receive and/or to which to feed shingled groups (12) of postal items; and a rear resting position in which said first segment (31) is part of a transportation system (14 or 24).

24. The system according to claim 22, wherein said first and fourth segment (31 and 34) are bidirectional, to be adapted both to receive and to feed shingled groups (12) of postal items.

* * * * *